US005774140A

United States Patent [19]

English

[11] Patent Number: 5,774,140

[45] Date of Patent: Jun. 30, 1998

[54] SKIP STROKE WIPING SYSTEM FOR INKJET PRINTHEADS

[75] Inventor: Kris M. English, Portland, Oreg.

[73] Assignee: Hewlett-Packard Company, Palo Alto, Calif.

[21] Appl. No.: 610,104

[22] Filed: Feb. 29, 1996

Related U.S. Application Data

[63] Continuation-in-part of Ser. No. 558,561, Oct. 31, 1995.

[51] Int. Cl.[6] ..... B41J 2/165

[52] U.S. Cl. ..... 347/33

[58] Field of Search ..... 347/20, 22, 33

[56] References Cited

U.S. PATENT DOCUMENTS 5,239,316 8/1993 Demarchi et al. ..... 347/33

5,266,974 11/1993 Koitabashi et al. ..... 347/33

5,416,395 5/1995 Hiramatsu et al. ..... 318/600

5,543,826 8/1996 Kuronuma et al. ..... 342/23

5,670,997 9/1997 Sugimoto et al. ..... 347/30

*Primary Examiner*—Adolf Berhane

*Attorney, Agent, or Firm*—Flory L. Martin

[57] ABSTRACT

A skip stroke wiping method of cleaning an inkjet printhead in an inkjet printing mechanism cleans a printhead that has an orifice plate, and first and second outboard regions located along two opposing sides of the orifice plate. In a bidirectional wiping routine, the ink residue is first wiped in a first direction from the orifice plate onto the first outboard region without touching the second outboard region. In a second wiping step, ink residue is wiped in a second direction opposite to the first direction from the orifice plate onto the second outboard region without touching the first outboard region. Thus, regions of the printhead having ink residue are skipped over in the wiping strokes to avoid contaminating the nozzles with previously wiped residue.

25 Claims, 4 Drawing Sheets

SKIP STROKE WIPING SYSTEM FOR INKJET PRINTHEADS

RELATED APPLICATIONS

This application is a continuation-in-part application of the pending U.S. patent application Ser. No. 08/558,561, filed on Oct. 31, 1995, which has at least one inventor in common herewith.

FIELD OF THE INVENTION

The present invention relates generally to inkjet printing mechanisms having more than one inkjet printhead, and more particularly to a skip stroke wiping system that avoids moving previously wiped away contaminants and residue back onto the printheads.

BACKGROUND OF THE INVENTION

Inkjet printing mechanisms use pens which shoot drops of liquid colorant, referred to generally herein as "ink," onto a page. Each pen has a printhead with an orifice plate that is formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

One unfortunate deficiency of the earlier wiping systems was the tendency to drag previously wiped away residue and contaminates back onto the nozzle face plate. FIG. 6 is a sectional, front elevational view of one such prior art wiping system employing an elastomeric wiper blade W. An inkjet cartridge 200, here a monochrome cartridge 200 has a printhead 202 cleaned by the wiper W. The printhead includes a face plate 204 that has a silicon orifice plate 205. The orifice plate 205 is surrounded by an electrical flex circuit having an exterior surface that defines left and right cheek regions 206 and 208 of the face plate 204. The orifice plate 205 defines a group of inkjet nozzles which extend through the plate, here arranged in two linear arrays 210, 212, shown in transverse cross section in FIG. 6. A pair of encapsulant beads 214, 216 along opposing edges of the orifice plate 205 covers the connection between the printhead resistors and the electrical flex circuit that defines the cheek regions 206, 208. The beads 214, 216 are preferably of an encapsulant material, such as an epoxy or plastic material. The flex circuit delivers firing signals to energize the printhead resistors, each of which are associated with a nozzle in the arrays 210, 212. Along the outboard side of each flex circuit cheek 206, 208 the printhead has two troughs 218, 220, respectively, which received some of the ink residue from the wiper W. To assist in removing some of the ink residue from the wiper W, the printhead may include a small outwardly projecting wiper scraper or lip, such as lips 222 and 224 adjacent the inboard sides of troughs 218 and 220, respectively.

Some of these earlier wiping systems used a bi-directional wiping scheme. In bi-directional wiping, the wiper W was first moved across the full width of the face plate 204 of printhead 202 as indicated by arrow 226 (to the right in FIG. 6), until the dashed line wiper position W' was reached, then back again in the opposite direction opposite arrow 226 (to the left in FIG. 6). The wiper W traversed not only across the nozzle orifice plate 205, but also across the cheek regions 206, 208 lying to each side of the orifice plate. The first wiping stroke deposited the contaminants to one side of the pen, here, along the cheek 208. Then during the next wiping stroke in the opposite direction (left in FIG. 6), the wiper W dragged the contaminants from cheek 208 back across the nozzles 210 and 212. This action deposits previously wiped contaminants onto the orifice plate 205, where the contaminants could be forced into the nozzles 210 and 212, causing a blockage.

An alternative to this earlier bi-directional wiping scheme was a unidirectional wiping approach. In this unidirectional system, the wiped-off contaminants were never brought back onto the orifice plate 205. Yet, this system had its disadvantages, too. In a unidirectional system, the wiper W typically traverses first across one array 210 then across the next array 212. While passing over the first array 210, the wiper W draws or wicks ink from the first array 210 and drags it toward the second array 212 where the ink serves as a solvent to dissolve dried ink residue. This wicked ink also lubricates the orifice plate 205 during wiping, which decreases frictional wear on both wiper W and the orifice plate 205. In a unidirectional wiping system, the nozzle arrays 210, 212 fail to receive equal treatment, as only one array 212 benefits from the lubrication and solvent properties provided by ink wicked from the other array 210. This unequal wiping treatment in a unidirectional wiping system could lead to premature printhead aging and failure.

SUMMARY OF THE INVENTION

According to one aspect of the present invention, a method of cleaning an inkjet printhead in an inkjet printing mechanism is provided for a printhead that has an orifice plate, and first and second outboard regions located along two opposing sides of the orifice plate. The method includes the step of first wiping ink residue from the orifice plate onto the first outboard region without touching the second outboard region. In a second wiping step, ink residue is wiped from the orifice plate onto the second outboard region without touching the first outboard region.

In the illustrated embodiment, the method may also include the steps of depositing a portion of any wiped ink residue in a first trough along an outboard side of the first outboard region opposite the orifice plate, and depositing a portion of any wiped ink residue in a second trough along an outboard side of the second outboard region opposite the orifice plate. In optional scraping steps, a portion of any wiped ink residue is scraped from the wiper using a first scraper portion of the printhead that projects outwardly from the first outboard region of the printhead, and a portion of any wiped ink residue is scraped from the wiper using a second scraper portion of the printhead that projects outwardly from the second outboard region of the printhead.

An overall goal of the present invention is to provide an inkjet printing mechanism which uses an advanced method of cleaning one or more inkjet printheads in the mechanism to aid in printing sharp vivid images.

Another goal of the present invention is to provide a skip stroke wiping system capable of reliably cleaning the nozzle face plates of inkjet printheads, whether containing a dye-based ink or a pigment-based ink.

DETAILED DESCRIPTION OF THE PREFERRED EMBODIMENTS

Figure 1:
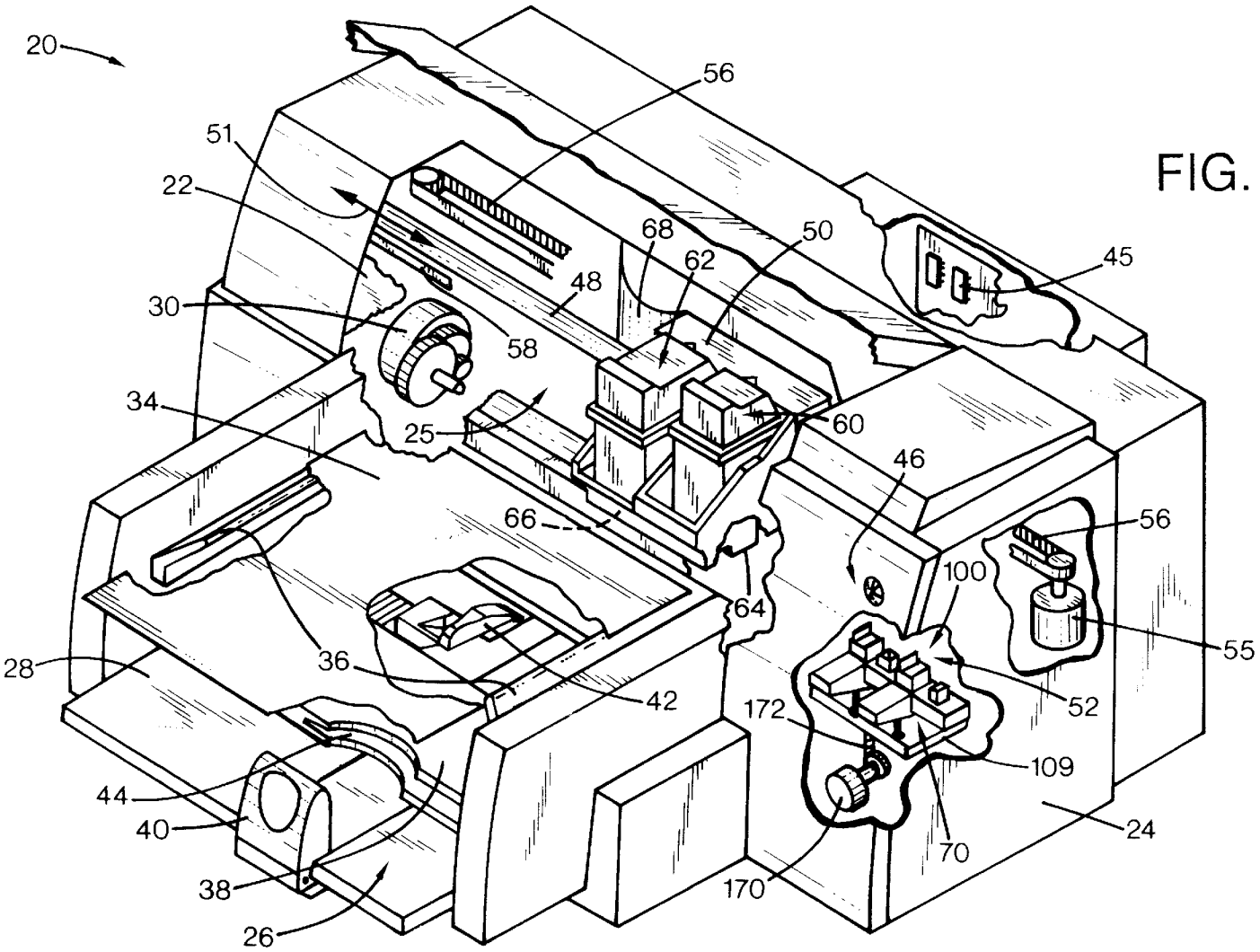
FIG. 1 is a fragmented, partially schematic, perspective view of one form of an inkjet printing mechanism using an adaptive wiping system of the present invention for servicing two diverse inkjet printheads having different servicing needs.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

In the print zone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. Indeed, for the purposes of illustration, the printheads 64, 66 are shown having the same construction as printhead 202 of cartridge 200, used in FIG. 6 to describe the earlier wiping systems and their deficiencies. The various components of printheads 64, 66 have the same item numbers as those assigned to cartridge 200 (face plate 204 with a silicon orifice plate 205, surrounded by an electrical flex circuit having an exterior surface that defines left and right cheek regions 206, 208; inkjet nozzles defined by orifice plate 205, here arranged in two linear arrays 210, 212 for the black printhead 64; a pair of encapsulant beads 214, 216 along opposing edges of orifice plate 205; two troughs 218, 220 beside outwardly projecting wiper scraper or lips 222, 224, respectively).

The color printhead 66 may be constructed as any conventional tri-chamber printhead, typically with three nozzle sets each comprising two or more linear nozzle arrays, or indeed, three (or more) separate monochrome pens may be used instead with the skip wipe system of the present invention. It is apparent that in such a color multi-cartridge printing mechanism, it may be more convenient to construct the service station 70 with a sled having one wiper per pen, or if contamination is not a problem, to have the wipers service two or more pens, although to increase servicing speed, one wiper per pen is preferred.

While the illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 from the controller 45 to the printhead carriage 50.

Skip Stroke Wiping System

Figure 2:
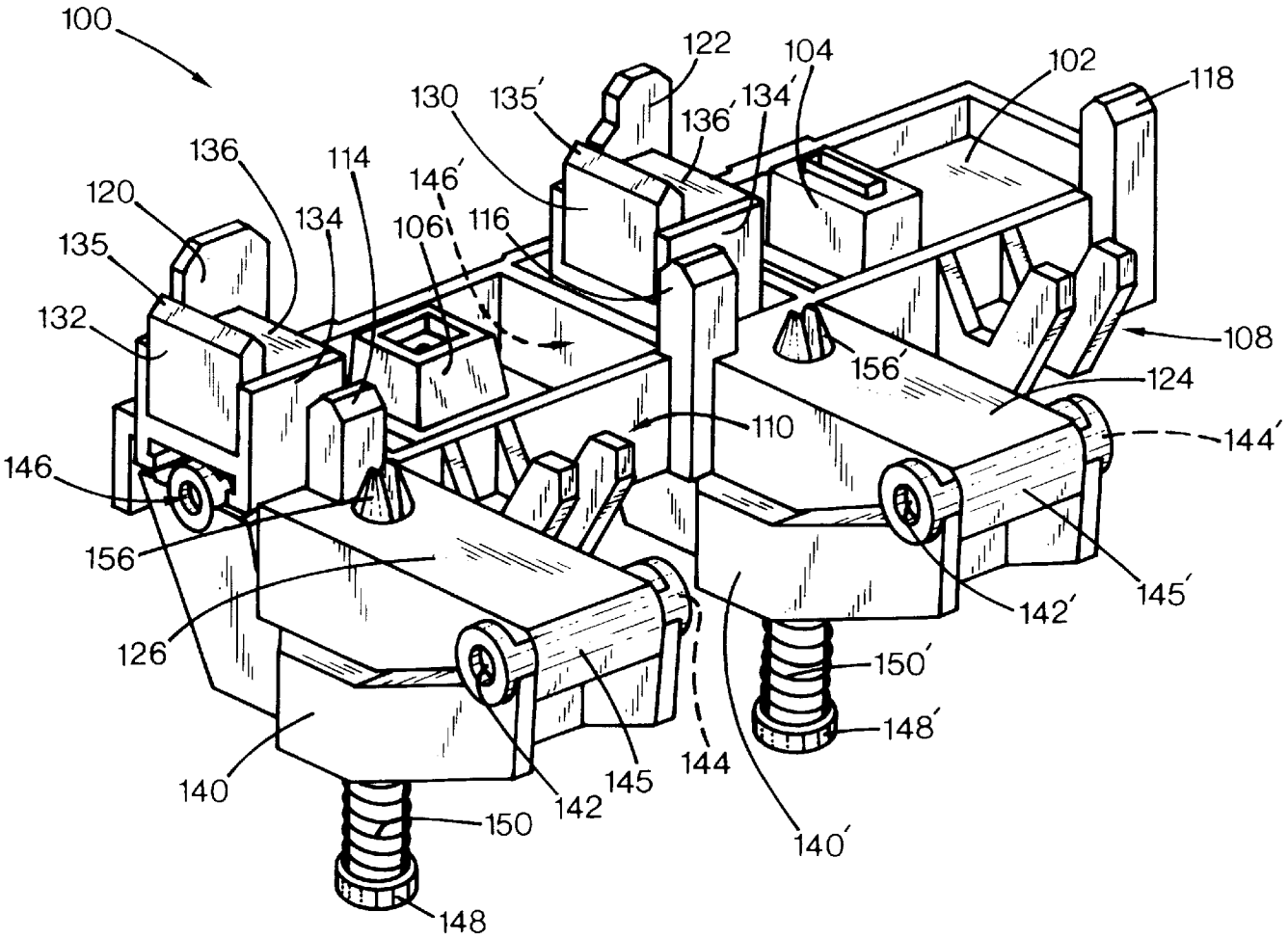
FIG. 2 is a perspective view of the main portion of the printhead service station of FIG. 1.
Figure 3:
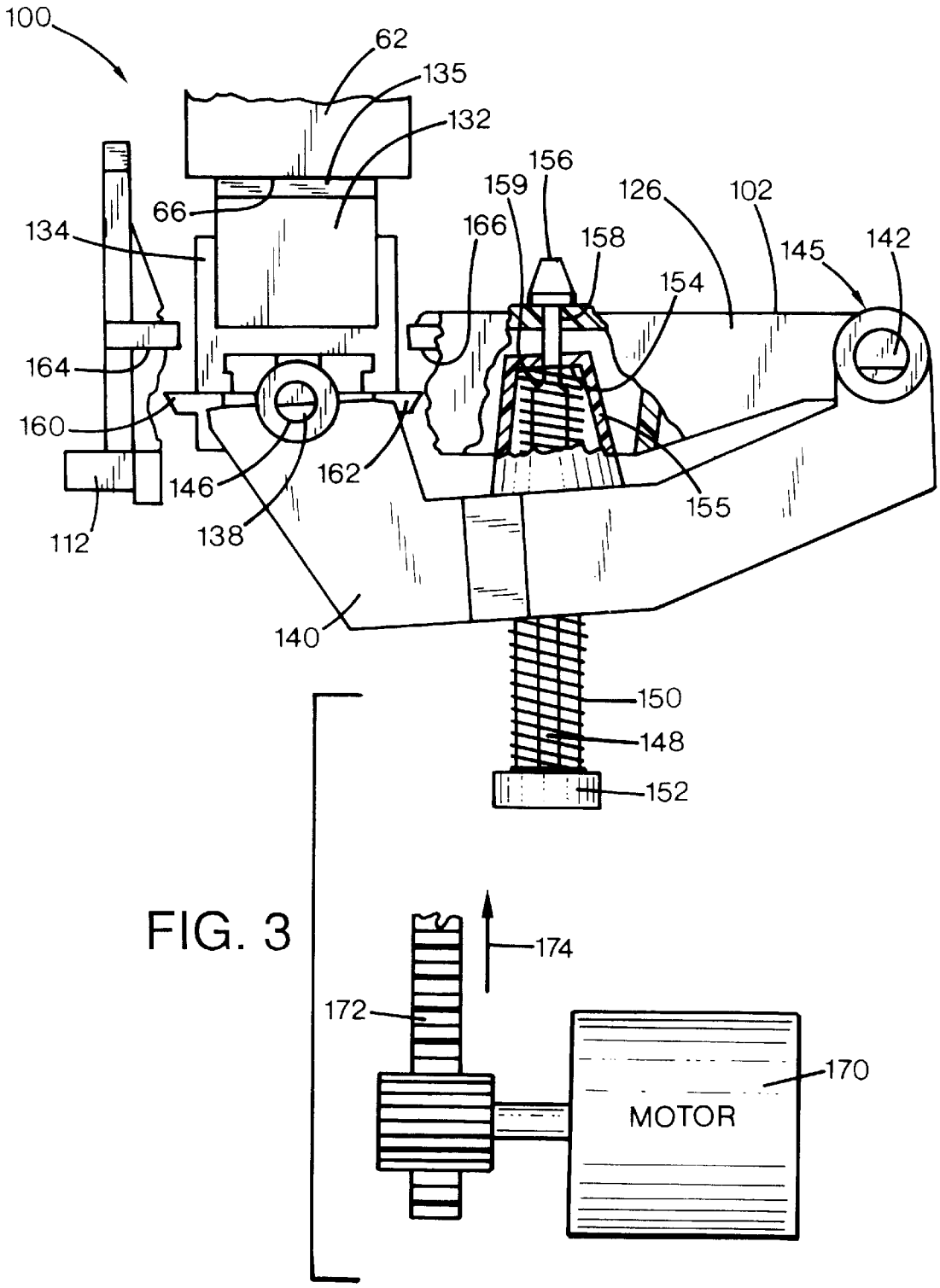
FIG. 3 is a partially fragmented, side elevational view of the adaptive wiper system of FIG. 1, shown wiping one inkjet printhead.

FIGS. 2 and 3 show one embodiment of a printhead service station 70 that resides within the servicing region 52 of the printer enclosure 24. The service station 70 includes a skip stroke wiping system 100 constructed in accordance with the present invention for servicing the inkjet cartridges 60, 62. The terms "skip stroke" or "skip wipe" will be better understood when the manner of operating the system 100 is described in detail below; however, before discussing the manner of operation, the various components of system 100 are first described. The illustrated wiper system 100 is an integral part of a pen capping and wiping system, including a sled 102 that supports various servicing implements. The sled 102 supports a black printhead cap 104 and a color printhead cap 106, for substantially sealing the respective black and color printheads 64, 66 during periods of printing inactivity. The caps 104, 106 may be of any conventional design.

The sled 102 may be moved into various servicing positions using a variety of different elevating mechanisms known to those skilled in the art, several of which are discussed further below. To assist in coupling the sled 102 to a base unit 109 coupled to such an elevating mechanism (not shown), the sled includes two sets of mounting arms 108, 110 (FIG. 2), and a rear mounting member 112 (FIG. 3). To assist in aligning the servicing components with the cartridges 60, 62, the sled 102 includes three alignment members 114, 116 and 118 located toward the front of the printer 20, and two rear alignment members 120, 122 located toward the rear of the sled 102.

The sled 102 has two support arms 124, 126 which extend forwardly from the main body of the sled. The wiper system 100 includes a black wiper 130 and a color wiper 132 for wiping printheads 64, 66, respectively. The wipers 130, 132 are preferably of a resilient, non-abrasive, elastomeric material, such as nitrile rubber, or more preferably ethylene polypropylene diene monomer (EPDM), or other comparable materials known in the art. In a preferred embodiment, the durometer of the EPDM wiper material is selected between the range of 40–100, on the Shore A scale, with a more preferred range being between 85–95, with a preferred nominal value being about 90, plus or minus a standard tolerance, such as ±5. It is apparent that the wipers 130, 132 may be made of different materials, or of materials having different durometers. However, to simplify manufacturing procedures, and to reduce the number of different parts required to assemble the printer 20, preferably the wipers 130 and 132 are of the same material and construction. For the same reasons, the manner of attaching the wipers 130, 132 to the sled 102 is preferably also the same. Thus, in describing the illustrated embodiment of attaching the wipers 130 and 132 to the sled 102, the components will be described with respect to the color wiper 132, and with similar parts for the black wiper 130 which are visible in the drawings being indicated with the same item number primed (').

For example, item number 134 is a stem portion which receives wiper 132, whereas item number 134' will be used to indicate the stem which receives wiper 130.

Thus, the illustrated wipers 132, 130 each include an upright wiper blade portion 135, 135' which is integrally formed with a block mounting portion 136, 136'. Each wiper blade 135, 135' has two opposing sides which taper into a peaked wiping edge that engages the respective printheads 66, 64. The wiper blades 135, 135' and the block portions 136, 136' are seated within the stem portions 134, 134'. The wiper stem 134, 134' has a pair of pivot posts, such as pivot post 138 (FIG. 3) which is pivotally received by a distal end of a wiper support arm 140, 140'. The wiper arm 140 has a proximate end supported by a pair of pivot posts 142 and 144 which extend outwardly from each side of the support arm 126 for supporting the color wiper 132. The wiper arm 140' is similarly supported by a pair of pivot posts 142' and 144' which extend outwardly from each side of the support arm 124 for supporting the black wiper 130. The pivot posts 142, 144 and 142', 144' define what is referred to herein as an elbow joint 145, 145', whereas the pivot posts 138 define a wrist joint, such as joint 146. Thus, the combination of the elbow and wrist joints form a dual pivoting wiper support system.

To bias the wiper arm 140 toward the sled 102, the wiper system 100 includes a biasing element or member, here illustrated as a retainer 148, 148' and a compression coil spring 150, 150'. Preferably, spring 150, 150' is selected to have a preferred spring rate of 0.05–0.15N/mm (Newtons per millimeter), or more preferably a spring rate of 0.05–0.10N/mm, and a preferred force of 0.4–0.8N, or more preferably a force of 0.5–0.65N both at a compressed length of approximately 27 mm, and at a free length of approximately 36 mm. One end of spring 150, 150' is retained by a lip 152 at the base of retainer 148. As best shown in FIG. 3, the other end of spring 150 is received within a pocket 154 defined by an upward protuberance 155 extending upwardly from arm 140. The spring retainer 148 has a distal end 156, 156' which extends through a hole 158 defined by and extending through support arm 126. Preferably, this is a loose fit which allows the retainer 148 to toggle and rock in hole 158 as arm 140 pivots during the wiping sequence.

To limit the downward motion of wipers 130, 132, the retainer 148, 148' has a shoulder portion 159 which engages the end of the pocket 154. Thus, downward motion of the wiper arm 140, 140' compresses the spring 150, 150' until the end of pocket 154 hits the retainer shoulder 159. Other biasing elements may also be used, for instance, a leaf spring (not shown) coupling the arm 140, 140' to the sled 102, or a torsional spring (not shown) located at the elbow joint 145, 145'. To limit the upward motion of the wipers 130, 132, the wiper stem 134, 134' includes a pair of prealignment features, such as projections, shelves or tabs 160, 162 which extend outwardly to engage a pair of engagement members, such as protuberances, abutments or stops 164, 166, respectively, extending from the sled 102. The wiper blades 130, 132 are advantageously held at an initial nominal position by engagement of the tabs 160, 162 with the respective stops 164, 166 before engaging the printheads 64, 66. This initial alignment advantageously minimizes wiper to printhead misalignment.

FIG. 3 shows the illustrated wiper system 100 raised to a servicing position, here, a wiping position, by a motor 170 and the elevation adjustment means provided by the rack and pinion gear 172, in the direction indicated by arrow 174. The sled 102 is coupled to the rack and pinion gear mechanism 172 by the base unit 109, shown schematically in FIG. 1. The gear mechanism 172 and base unit 109 may be constructed in any conventional manner to move the wipers 130, 132 into engagement with the respective printheads 64, 66, for instance, by using the mechanism shown in U.S. Pat. No. 5,155,497, assigned to the present assignee, Hewlett-Packard Company. Other mechanisms may also be used to move sled 102 into a wiping position, such as by moving the sled 102 laterally up a ramp (not shown) using the concepts expressed in U.S. Pat. No. 5,440,331, also assigned to the present assignee, Hewlett-Packard Company.

Figure 5:
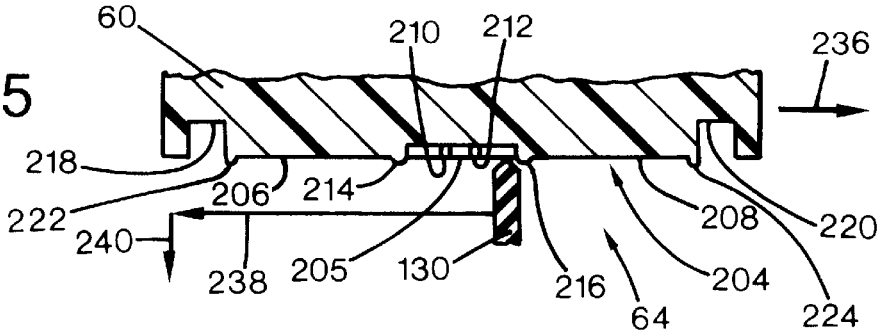

In the side elevational view of FIG. 3, the color wiper 132 is shown wiping the color printhead 66. At a similar elevation, it is apparent that the black wiper 130 may wipe the black printhead 64 in a similar manner. In FIG. 3, spring 150 is compressed to a nominal amount, although it is apparent that greater compressions may be experienced, until the end of the arm pocket 154 hits the retainer shoulder 159. Such an extreme compressed position may accommodate a very close printhead to sled spacing (high interference) when the wiper blade 135, 135' is engaged by the printhead 66, 64 (FIGS. 1 and 5). Other pen-to-sled spacings may be accommodated by the varying degrees of compression experienced by the springs 150, 150'.

If the face plate of the printhead 66, 64 is crooked with respect to sled 102, that is, tilted or offset from front to rear (perpendicular with the scanning axis 51) of a plane parallel with the sled, then flexure of the wrist joint 146 automatically aligns the peaked wiping edge of blade 135 parallel to the face plate. Preferably, the wiper blades 130, 132 are initially held at a nominal position by engagement of the tabs 160, 162 with the respective stops 164, 166 before contacting the printheads 64, 66. Then after engagement, the wrist joint 146, 146' flexes preferably about 1° either toward the front or back of the printer to accommodate any misalignment of the printhead with respect to sled 102. It is apparent that any given embodiment of this wiper system may be modified to accommodate other angles of printhead-to-sled misalignment, and the 1° value (as well as other component values given herein) is only given to describe the illustrated embodiment. As the wiper blade 135, 135' moves across the printhead (either by moving the wiper, or as shown here, by moving the printhead), the wrist joint 146, 146' can flex to maintain contact across the entire width of the face plate.

By maintaining this dual pivoting action of joints 145, 145' and 146, 146' within a single plane (parallel with the sheet of paper in FIG. 3), the wiper blade 135, 135' remains in a substantially upright alignment for wiping the respective printheads 66, 64. During wiping, the contact angle remains the same, independent of the degree of interference of the wiper and printhead, regardless of whether it is a high interference (close spacing), a nominal interference (nominal spacing), or a low interference (larger printhead to sled spacing), where spring 150, 150' is only compressed minimally. Regardless of the degree of spacing between the printheads 64, 66 and sled 102, the illustrated wiping system 100 compensates for these variations, as well as for any lack of parallelism between the printheads and the wiper blade tips 135, 135'. Moreover, if the printhead also is canted from side-to-side (not parallel with the scanning axis 51), the wiping system 100 automatically accommodates for this circumstance by just changing the compression of the spring 150, 150' as the printhead 66, 64 is moved over the wiper 132, 130.

Advantageously, the wiper blades 135, 135' are located to engage the nozzle orifice plates of printheads 64, 66 at the same relative location and at the same time. The advantage realized by this unique configuration is the ability to wipe the printheads 64, 66 simultaneously with the same skip stroke wiping scheme. In operation, during printing the sled 102 of the service station 70 is at a rest position, lowered away from the path of printhead travel. In this rest position, the spring 150, 150' preferably pre-loads the wiper arm 140, 140' to force the tabs 160, 162 of stems 134, 134' into contact with the sled stops 164, 166, respectively. To initiate servicing, the motor 170 (FIG. 1) and gear mechanism 172 cooperate to move the sled 102 toward the printheads, in the direction indicated by arrow 174.

Upon engaging the wipers 130, 132 with the printheads 64, 66, the biasing springs 150, 150' are compressed as the arm 140, 140' rocks downward, pivoting at elbow joint 145, 145'. This downward pivoting at elbows 145, 145' allows the wiper stem 134, 134' to pivot at wrist joint 146, 146' to rock the edges of the wiper blades 135, 135' into full engagement with each printhead 66, 64, which accommodates for any angular wiper to printhead misalignment. Pivoting at the elbow joints 145, 145' compensates for printhead to sled spacing variations. These angular and spacing variations may be caused by part tolerance accumulations, or less than optimal pen seating in carriage 50. During wiping the upright structure of blade 135, 135' remains at a substantially constant angle with respect to the printheads 64, 66. In practicality, there is very little bending of the blade 135, 135' with respect to the stem 134, 134' during wiping, due to the downward motion of arm 140, 140'. During wiping, the wiper load increases the force applied to the spring 150, 150' over the initial pre-load force used to bias the wiper into a seated position at rest. The spring 150, 150' pushes or urges the wiper blade 135, 135' into constant engagement with the printhead 66, 64 at a force which may be varied by selecting the spring with a particular rate and force.

Figure 4:
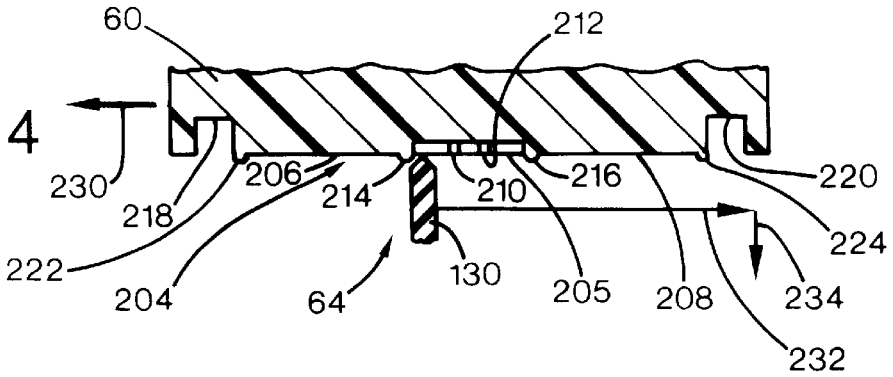
FIGS. 4 and 5 are sectional, front elevational views of the wiping system of FIG. 1, showing different stages of a preferred bi-directional wiping sequence.
Figure 6:
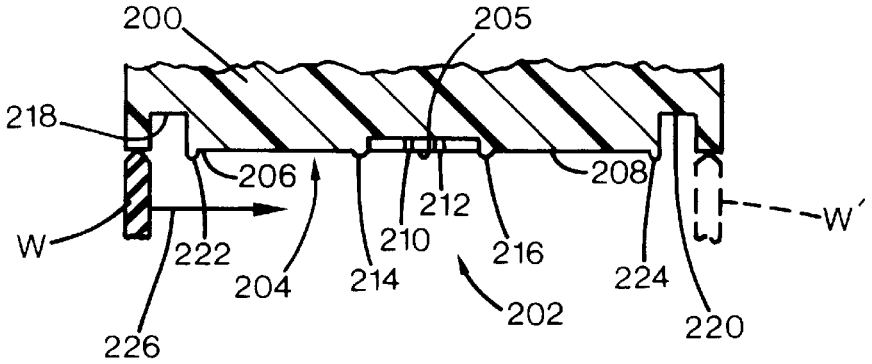
FIG. 6 Prior Art
FIG. 6 is a sectional, front elevational view of a prior art wiping system described in the Background section above.

As shown in FIGS. 4 and 5, the position at which the wipers 130, 132 engage the printheads 64, 66 differs in the skip stroke wiping system from that described with respect to FIG. 6 in the Background portion above. While FIGS. 4 and 5 illustrate wiping of the black printhead 64, it is apparent that the same wiping sequence is simultaneously performed on the color printhead 66. Indeed, the skip wipe system 100 may also be used in a printing mechanism having a single inkjet printhead, such as a monochrome printer or one that accepts interchangeable black and tri-color inkjet cartridges.

In FIG. 4, the first portion of the bi-directional wiping stroke shows the first contact of wiper 130 with the printhead 64 occurs at the left edge of the orifice plate 205, preferably adjacent the encapsulent bead 214. In the illustrated embodiment, the printhead 64 was positioned by carriage 50 at the location shown and the service station motor 170 drove the wiper upward (arrow 174 in FIG. 3) into engagement with the orifice plate 205. With wiper 130 at this wiping position, the carriage 50 then moves the cartridge to the left, as indicated by arrow 230, so the relative motion between the printhead and wiper effectively draws the wiper over array 210, then array 212, and across cheek 208, as indicated by arrow 232. Along cheek 208 near the scraper lip 224 and trough 220, the wiper deposits any ink residue and contaminates removed from the orifice plate 205. When the wiper 130 has passed over the trough 220, the service station motor 170 then lowers the sled 102 and wiper 130 away from the printhead, as indicated by arrow 234. Thus, wiping of the left cheek 206 has been skipped during this first portion of the bidirectional wiping stroke, so any contaminates previously accumulated on cheek 206 are not deposited on the orifice plate 205.

In FIG. 5, the second portion of the bidirectional wiping stroke shows the next contact of wiper 130 with the printhead 64 occurs at the right edge of the orifice plate 205, preferably adjacent the encapsulent bead 216. Again, the printhead 64 was positioned by carriage 50 at the location shown, and motor 170 drove the wiper upward (arrow 174 in FIG. 3) into engagement with orifice plate 205. With the wiper 130 at this wiping position, the carriage 50 then moves the cartridge 60 to the right, as indicated by arrow 236, so the relative motion between the printhead and wiper effectively draws the wiper over array 212, then array 210, and across the cheek 206, as indicated by arrow 238. Along cheek 206 near scraper lip 222 and trough 218, the wiper deposits any ink residue and contaminates removed from the orifice plate 205. When the wiper 130 has passed over the trough 218, the service station motor 170 then lowers the sled 102 and wiper 130 away from the printhead, as indicated by arrow 240. Thus, wiping of the right cheek 208 has been skipped during this second portion of the bi-directional wiping stroke. In this manner, any contaminates deposited on cheek 208 during the first portion of the wiping stroke (shown in FIG. 4) are not deposited on the orifice plate 205.

Conclusion

Thus, it is clear that the skip stroke wiping system 100 improves the cleaning of the printheads 64, 66 over that possible with the earlier wiping systems described with respect to FIG. 6. Here, the wipers 130, 132 enter the wiping stroke on the orifice plates of cartridges 64, 66, then they wipe across the nozzles and drag ink debris to one cheek. The wipers then disengage the printhead for repositioning to engage the orifice plate adjacent the edge where the debris was just deposited, that is, now on the opposite side of the orifice plate from where the first portion of the stroke started. The wiper then cleans the orifice plate in the opposite direction and drags ink debris to the opposite cheek. This skip wipe system advantageously eliminates having the wiper traverse areas having ink residue, such as the tar-like ink residue produced the illustrated black pigment based ink. In this manner, the wiper only touches a clean orifice plate before coming into contact with the nozzles 210 and 212. This system significantly reduces the amount of contaminants brought back onto the nozzle plate over that experienced with the earlier bi-directional wiping systems (FIG. 6), so nozzle blockage from these contaminants is advantageously avoided.

Moreover, by using a bi-directional wiping system, rather than the earlier unidirectional wiping schemes, each nozzle array is used as a solvent source for the other array. That is, during the first portion of the stroke in FIG. 4, ink is wicked from nozzle array 210 and pulled by the wiper over to serve as a solvent for array 212. During the second portion of the stroke (FIG. 5) ink is wicked from array 212 and pulled by the wiper to array 210. The wicked ink also serves as a lubricant between the wiper and the orifice plate 205, advantageously minimizing wiper wear and printhead wear.

I claim:

1. A method of cleaning an inkjet printhead in an inkjet printing mechanism, with the printhead having an orifice plate, and first and second outboard regions located along two opposing sides of the orifice plate, the method comprising the steps of:

first wiping ink residue from the orifice plate onto the first outboard region without touching the second outboard region; and second wiping ink residue from the orifice plate onto the second outboard region without touching the first outboard region.

2. A method according to claim 1 wherein the first and second wiping steps each include the step of moving the orifice plate across a wiper.

3. A method according to claim 2, further including the steps of:

after the first wiping step, scraping a portion of any wiped ink residue from the wiper using a first scraper portion of the printhead that projects outwardly from the first outboard region of the printhead; and after the second wiping step, scraping a portion of any wiped ink residue from the wiper using a second scraper portion of the printhead that projects outwardly from the second outboard region of the printhead.

4. A method according to claim 1 wherein:

the first wiping step further includes the step of depositing a portion of any wiped ink residue in a first trough along an outboard side of the first outboard region opposite the orifice plate; and the second wiping step further includes the step of depositing a portion of any wiped ink residue in a second trough along an outboard side of the second outboard region opposite the orifice plate.

5. A method according to claim 1 wherein:

the orifice plate defines plural nozzles, including first and second nozzles mutually spaced apart, with the first nozzle located on the orifice plate closer to the first outboard region than to the second outboard region, and the second nozzle located on the orifice plate closer to the second outboard region than to the first outboard region;

the first wiping step comprises the steps of wicking ink from the second nozzle, and lubricating the orifice plate using the ink wicked from the second nozzle; and the second wiping step comprises the steps of wicking ink from the first nozzle, and lubricating the orifice plate using the ink wicked from the first nozzle.

6. A method according to claim 1 wherein:

the orifice plate defines plural nozzles, including first and second nozzles mutually spaced apart, with the first nozzle located on the orifice plate closer to the first outboard region than to the second outboard region, and the second nozzle located on the orifice plate closer to the second outboard region than to the first outboard region;

the first wiping step comprises the steps of wicking ink from the second nozzle, transporting the ink wicked from the second nozzle to the first nozzle, and dissolving any ink residue adjacent the first nozzle with the ink wicked from the second nozzle; and the second wiping step comprises the steps of wicking ink from the first nozzle, transporting the ink wicked from the first nozzle to the second nozzle, and dissolving any ink residue adjacent the second nozzle with the ink wicked from the first nozzle.

7. A method of cleaning an orifice plate of an inkjet printhead in an inkjet printing mechanism, with printhead having a first region and a second region with the orifice plate being sandwiched therebetween, the method comprising the steps of:

without contacting either the first region or the second region of the printhead, first positioning the orifice plate and a wiper into mutual engagement adjacent plural nozzles defined by the orifice plate and along a first edge of the orifice plate;

first wiping any ink residue from the orifice plate and plural nozzles using the wiper through relative movement of the orifice plate and the wiper in a first direction; and first depositing any wiped ink residue along said first region of the printhead.

8. A method according to claim 7, further including the steps of, after the first depositing step:

without contacting either the first region or the second region of the printhead, second positioning the orifice plate and the wiper into mutual engagement adjacent the plural nozzles and along a second edge of the orifice plate opposite the first edge of the orifice plate;

second wiping any ink residue from the orifice plate and plural nozzles using the wiper through relative movement of the orifice plate and the wiper in a second direction opposite the first direction; and second depositing any wiped ink residue along said second region of the printhead.

9. A method according to claim 8 wherein:

the first and second positioning steps each comprise moving the wiper into engagement with the orifice plate; and the relative movement of the first and second wiping steps comprises moving the orifice plate across the wiper.

10. A method according to claim 7, further including the step of, after the first wiping step, scraping a portion of any wiped ink residue from the wiper using a scraper portion of the printhead that projects outwardly from the first region of the printhead.

11. A method according to claim 8, further including the steps of:

after the first wiping step, scraping a portion of any wiped ink residue from the wiper using a first scraper portion of the printhead that projects outwardly from the first region of the printhead; and after the second wiping step, scraping a portion of any wiped ink residue from the wiper using a second scraper portion of the printhead that projects outwardly from the second region.

12. A method according to claim 7 wherein the first depositing step further includes the step of depositing a portion of any wiped ink residue in a trough along an outboard side of the first region of the printhead opposite the orifice plate.

13. A method according to claim 8 wherein:

the first depositing step further includes the step of depositing a portion of any wiped ink residue in a first trough along an outboard side of the first region of the first printhead opposite the first orifice plate; and the second depositing step further includes the step of depositing a portion of any wiped ink residue in a second trough along an outboard side of the second region of the second printhead opposite the second orifice plate.

14. A method according to claim 7 wherein:

said inkjet printhead comprises a first inkjet printhead;

said orifice plate comprises a first orifice plate;

said wiper comprises a first wiper;

the printing mechanism further includes a second inkjet printhead having a second orifice plate defining plural nozzles therethrough;

the first positioning step further comprises positioning the second orifice plate and a second wiper into mutual engagement adjacent the plural nozzles of the second orifice plate along a first edge of the second orifice plate;

the first wiping step further comprises wiping any ink residue from the second orifice plate and the plural nozzles thereof using the second wiper through relative movement of the second orifice plate and the second wiper in the first direction; and the first depositing step further comprises depositing any wiped ink residue from the second orifice plate along a first region of the second printhead bordering the second orifice plate.

15. A method of cleaning an orifice plate of an inkjet printhead in an inkjet printing mechanism, comprising the steps of:

first positioning the orifice plate and a wiper into mutual engagement adjacent plural nozzles defined by the orifice plate and along a first edge of the orifice plate;

first wiping any ink residue from the orifice plate and plural nozzles using the wiper through relative movement of the orifice plate and the wiper in a first direction;

first depositing any wiped ink residue along a first region of the printhead bordering the orifice plate;

wherein said inkjet printhead comprises a first inkjet printhead;

wherein said orifice plate comprises a first orifice plate;

wherein said wiper comprises a first wiper;

wherein the printing mechanism further includes a second inkjet printhead having a second orifice plate defining plural nozzles therethrough;

wherein the first positioning step further comprises positioning the second orifice plate and a second wiper into mutual engagement adjacent the plural nozzles of the second orifice plate along a first edge of the second orifice plate;

wherein the first wiping step further comprises wiping any ink residue from the second orifice plate and the plural nozzles thereof using the second wiper through relative movement of the second orifice plate and the second wiper in the first direction;

wherein the first depositing step further comprises depositing any wiped ink residue from the second orifice plate along as first region of the second printhead bordering the second orifice plate; and after the first depositing step:

second positioning the first wiper and the first orifice plate into mutual engagement adjacent the plural nozzles of the first orifice plate and along a second edge of the first orifice plate opposite the first orifice plate and along a simultaneously, positioning the second wiper and the second orifice plate into mutual engagement adjacent the plural nozzles of the second orifice plate and along a second edge of the second orifice plate opposite the first edge thereof;

second wiping any ink residue from the first orifice plate and plural nozzles thereof using the first wiper through relative movement of the first orifice plate and the first wiper in a second direction opposite the first direction, and simultaneously, wiping any ink residue from the second orifice plate and plural nozzles thereof using the second wiper through relative movement of the second orifice plate and the second wiper in the second direction opposite the first direction; and second depositing any wiped ink residue from the first orifice plate along a second region of the first printhead bordering the first orifice plate opposite the first region thereof, and simultaneously, depositing any wiped ink residue from the second orifice plate along a second region of the second printhead bordering the second orifice plate opposite the first region thereof.

16. A method of cleaning an inkjet printhead in an inkjet printing mechanism, with the printhead having an orifice plate, and first and second regions located along two opposing sides of the orifice plate, the method comprising the steps of:

first providing relative motion between a wiper and the printhead in a first direction to move the wiper across the first region, then across the orifice plate, and finally across the second region;

second providing relative motion between the wiper and the printhead in a second direction opposite to the first direction to move the wiper across the second region, then across the orifice plate, and finally across the first region;

during the first providing step, skipping the wiper over the first region without contacting the wiper with the first region, then contacting the orifice plate and second region with the wiper; and during the second providing step, skipping the wiper over the second region without contacting the wiper with the second region, then contacting the orifice plate and first region with the wiper.

17. A method according to claim 16 wherein the relative movement of the first and second providing steps comprises moving the orifice plate across the wiper.

18. A method according to claim 16 wherein:

during the first providing step, the contacting step comprises the steps of removing ink residue from the orifice plate and depositing the removed ink residue onto the second region; and during the second providing step, the contacting step comprises the steps of removing ink residue from the orifice plate and depositing the removed ink residue onto the first region.

19. A method according to claim 16 wherein:

during the first providing step, the contacting step comprises the steps of removing ink residue from the orifice plate and depositing the removed ink residue in a trough located along an outboard side of the second region; and during the second providing step, the contacting step comprises the steps of removing ink residue from the orifice plate and depositing the removed ink residue in another trough located along an outboard side of the first region.

20. A method according to claim 16 further including the steps of:

during the second providing step, scraping a portion of any ink residue accumulated on the wiper during the contacting step by using a first scraper portion of the printhead that projects outwardly from the first region of the printhead; and during the first providing step, scraping a portion of any ink residue accumulated on the wiper during the contacting step by using a second scraper portion of the printhead that projects outwardly from the second region of the printhead.

21. A method of cleaning an inkjet printhead in an inkjet printing mechanism, with the printhead having an orifice plate, and first and second outboard regions located along two opposing sides of the orifice plate, wherein the orifice plate defines plural nozzles, including first and second nozzles mutually spaced apart, with the first nozzle located on the orifice plate closer to the first outboard region than to the second outboard region, and the second nozzle located on the orifice plate closer to the second outboard region than to the first outboard region, the method comprising the steps of:

first wiping ink residue from the orifice plate onto the first outboard region without touching the second outboard region;

during the first wiping step, wicking ink from the second nozzle;

second wiping ink residue from the orifice plate onto the second outboard region without touching the first outboard region; and during the second wiping step, wicking ink from the first nozzle.

22. A method according to claim 21, further including the steps of:

during the first wiping step, lubricating the orifice plate using the ink wicked from the second nozzle; and during the second wiping step, lubricating the orifice plate using the ink wicked from the first nozzle.

23. A method according to claim 21 wherein:

during the first wiping step, transporting the ink wicked from the second nozzle to the first nozzle, and dissolving ink residue adjacent the first nozzle with the ink wicked from the second nozzle; and during the second wiping step, transporting the ink wicked from the first nozzle to the second nozzle, and dissolving ink residue adjacent the second nozzle with the ink wicked from the first nozzle.

24. A method according to claim 21 wherein the first and second wiping steps each include the step of moving the orifice plate across a wiper.

25. A method according to claim 21, further including the steps of:

after the first wiping step, scraping a portion of any wiped ink residue from the wiper using a first scraper portion of the printhead that projects outwardly from the first outboard region of the printhead; and after the second wiping step, scraping a portion of any wiped ink residue from the wiper using a second scraper portion of the printhead that projects outwardly from the second outboard region of the printhead.

* * * * *

UNITED STATES PATENT AND TRADEMARK OFFICE

CERTIFICATE OF CORRECTION

PATENT NO : 5,774,140

DATED : June 30, 1998

INVENTOR(S) : English

It is certified that error appears in the above-identified patent and that said Letters Patent is hereby corrected as shown below:

IN THE CLAIMS

Column 11 (line 57), begin a new paragraph after "; and".

Column 13 (line 24), delete second occurrence of "orifice" and insert therefor --edge thereof,--.

Column 13 (line 25), delete "plate".

Column 13 (line 25), after "and" delete "along a".

Signed and Sealed this

Seventh Day of September, 1999

*Attest:*

Q. TODD DICKINSON

*Attesting Officer*

*Acting Commissioner of Patents and Trademarks*